United States Patent [19]

Lautenschläger, Jr.

[11] Patent Number: 4,706,332

[45] Date of Patent: Nov. 17, 1987

[54] CABINET HINGE

[75] Inventor: Karl Lautenschläger, Jr., Reinheim, Fed. Rep. of Germany

[73] Assignee: Karl Lautenschläger GmbH & Co. KG, Reinheim, Fed. Rep. of Germany

[21] Appl. No.: 917,413

[22] Filed: Oct. 10, 1986

[30] Foreign Application Priority Data

Oct. 14, 1985 [DE] Fed. Rep. of Germany ..... 3536568

[51] Int. Cl.[4] ..... E05D 7/04; E05D 7/06

[52] U.S. Cl. ..... 16/241; 16/246

[58] Field of Search ..... 16/238, 240, 241, 245, 16/246, 324, 326, 333, 347, 349, 370, 382; 16/237, 239, 258

[56] References Cited

U.S. PATENT DOCUMENTS 4,417,366 11/1983 Salice ..... 16/258

4,517,706 5/1985 Lautenschläger ..... 16/238

FOREIGN PATENT DOCUMENTS 43903 1/1982 European Pat. Off. ..... 16/382

3223937 12/1983 Fed. Rep. of Germany ..... 16/238

*Primary Examiner*—Nicholas P. Godici

*Assistant Examiner*—Edward Brown

[57] ABSTRACT

Cabinet hinge whose cabinet-wall-related part in the form of a cantilever arm can be slipped onto a mounting plate installed on the wall of a cabinet and can then be fixed at selected positions on the mounting plate by tightening a screw. The mounting plate bears a resilient catch which, at the beginning of the installation of the cantilever arm engages an abutment on the latter and thus secures it against accidental withdrawal from the mounting plate, without interfering with its movement for longitudinal adjustment on the mounting plate. The catch is provided on a leaf spring which is fastened at one end within the mounting plate while its free end bearing the catch protrudes through an opening in the mounting plate. The arm-holding screw is passed with clearance through an oversize hole in the mounting plate and driven into a threaded eye in the leaf spring.

6 Claims, 4 Drawing Figures

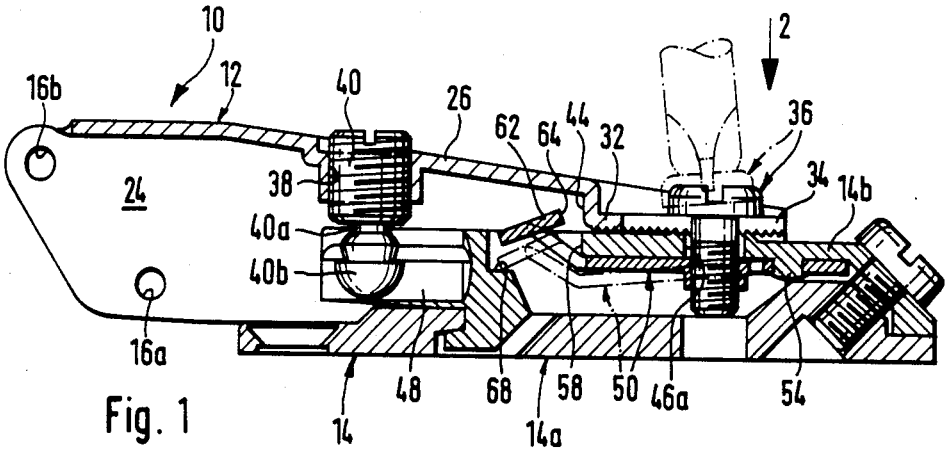
Fig. 1
Fig. 2
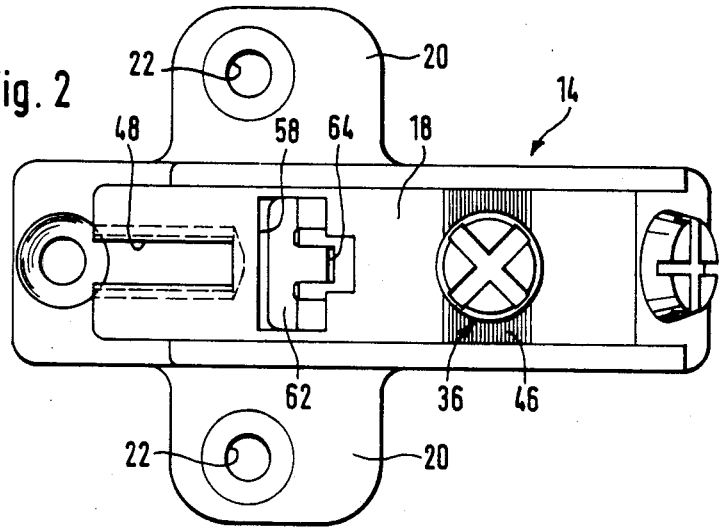
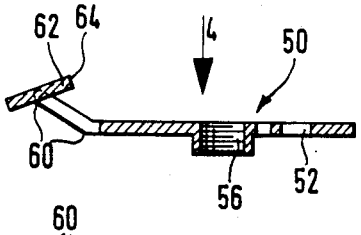
Fig. 3
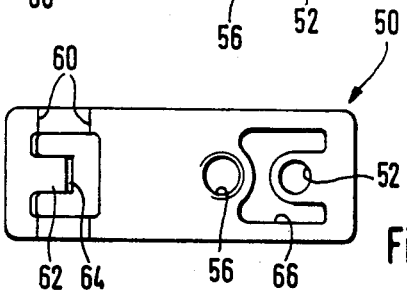
Fig. 4

CABINET HINGE

BACKGROUND OF THE INVENTION

The invention relates to a cabinet hinge having a wall-related part in the form of an elongated arm of substantially channel-like cross section which is coupled pivotingly by a linkage to the door-related part. The door is mounted for adjustment in at least two coordinate directions on a mounting plate which can be fastened to the wall of a cabinet, while the flanges of the channel at least partially straddle the mounting plate. The web portion of the arm, at its end remote from the hinge link, has a longitudinal slot with an open end or an enlarged pass-through opening through which passes the shank of a holding screw threaded into the mounting plate. The web is also provided at a distance from the slot with a tap through which a threaded spindle is driven so as to thrust against the mounting plate. In an inside surface of the arm facing the mounting plate there is provided an abutment which projects toward the hinge-link end of the arm, and in the area of the mounting plate opposite this abutment a projecting resilient catch is provided. The catch on the mounting-plate is adapted to engage the abutment on the arm when the arm is displaced lengthwise parallel to the wall on the mounting plate, just as the shank of the screw driven into the mounting plate enters into the rearward area of transition between the longitudinal slot and the pass-through opening or open end of the slot.

Cabinet hinges of this kind (U.S. Pat. No. 4,517,706) have overcome the disadvantage of older hinges which consists in the danger of the separation of the arm from the mounting plate and thus the dropping of a door attached to a cabinet with such hinges as long as the screws holding the arm on the mounting plate are not tightened, because, for example, a precise adjustment of the depth or of the overlap of the door relative to the cabinet is yet to be performed. By means of the catch on the mounting plate and its abutment on the arm, which engage one another when the arm is pushed onto the mounting plate, the assurance is provided that accidental separation is no longer possible. At the same time the possibility of the adjustment of the arm on the mounting plate and thus of the door relative to the cabinet is made no more difficult than it was in the case of the older hinges. The known hinges have proven practical and are widely used.

To release the safety catch in these hinges when a door is to be removed from the cabinet for furniture moving purposes, it is necessary only to back out the screw holding the arm on the mounting plate by such an additional amount that the arm can be raised at right angles to the wall such that the abutment on the arm can be disengaged from the catch on the mounting plate. In the raised position the arm can then be withdrawn from the mounting plate. The deliberate backing off of the screws for this purpose does not involve much work, but it has the disadvantage that the safety-catching of the arm on the mounting plate is not assured when the door is later reinstalled on the cabinet if one has forgotten to turn the screw back into the mounting plate by the necessary amount.

Accordingly, the invention is addressed to the problem of improving the known hinges such that the safety catch securing the arm on the mounting plate can be more easily and quickly disengaged in case of need without loss of effectiveness and security, and can be automatically restored upon subsequent reassembly without the need for special measures or manipulations.

SUMMARY OF THE INVENTION

Setting out from a cabinet hinge of the kind mentioned in the beginning, this problem is solved according to the invention in that the resilient catch is in the form of a leaf spring which is disposed in the hollow interior of the mounting plate with its end remote from the hinge linkage affixed to the corresponding end of the mounting plate, and which extends toward the hinge linkage in substantially parallel contact with the underside of the mounting plate bridge spanning its hollow interior; in that the free end of the leaf spring has a portion bent toward the arm through a cutout in the bridge of the mounting plate and forming a catch, and in that the holding screw driven into the mounting plate passes freely through an oversize bore in the mounting plate bridge, and is screwed into a complementary threaded eye provided in the leaf spring underneath the oversize bore. Therefore, unlike the state of the art, the threaded portion of the holding screw is not driven into the mounting plate but into the threaded eye in the leaf spring through the oversize bore in the mounting plate. By backing the holding screw out of the threaded eye, the arm previously clamped against the mounting plate can be loosened and drawn out until the abutment on the arm and the catch on the leaf spring engage one another, i.e., to a point just before the arm becomes separated from the mounting plate. For the final release, however, the free end of the leaf spring must be deflected toward the cabinet wall until the catch and its abutment are free and clear of one another. This is accomplished simply by pressing the loosened holding screw downward, i.e., toward the cabinet wall. The leaf spring is thereby deflected downwardly, and its free end bearing the catch goes back into the cutout in the bridge of the mounting plate, thereby disengaging the safety catch and releasing the arm. The head of the holding screw, therefore, serves not only for engagement by a screwdriver to fasten or unfasten the arm on the mounting plate, but it also constitutes a pushbutton for the release of the safety catch. Since the holding screw is much closer to the fixed end of the leaf spring than to the free end bearing the catch, the releasing movement performed on the leaf spring with the holding screw loosened will be proportional to the lever arms measured between the threaded eye and fixed end on the one hand and between the catch and the fixed end on the other. In other words, the holding screw needs only to be backed out from the threaded eye in the leaf spring by a small amount in order to produce the greater movement required for the release of the arm at the location of the catch and its cooperating abutment.

The catch abutment on the arm can be formed by creating an indentation in the web of the arm, and the hinge-linkage end of the depression surrounding the longitudinal slot in the arm is available for this purpose.

In the hollow of the mounting plate underneath the cutout in its bridge, there is provided, in an advantageous further development of the invention, an abutment for the arris at the free end of the leaf spring, this abutment being disposed at such a distance below the cutout that, when the free end of the leaf spring is pushed downwardly, the edge of the catch will disappear just below the surface of the bridge. The releasing movement of the catch is thus limited to what is necessary, assuring that, even if the holding screw is backed out more than is needed, the leaf spring can still be depressed no more than the small amount necessary for the release of the catch. Any accidental excessive flexing of the leaf spring that might result in permanent deformation so that the catch and its abutment might fail to engage one another is thus prevented.

The leaf spring is best riveted at its end remote from the hinge link to the underside of the bridge of the mounting plate.

To provide the leaf spring with the necessary strength, and at the same time to give it sufficient resilience, it is recommendable to provide it with a cutout in the area between its threaded eye and its fixed end, thus reducing its resistance to flexure in the area beside the cutout in comparison to the other areas of the spring.

To form the catch, it is expedient to provide a cutout also in the free end area of the leaf spring, giving it such a shape that a tongue projecting towards the fixed end of the spring will be created. Then the free end of the spring is bent downwardly along a transverse line so that the free end of the tongue will project upwardly through the cutout in the bridge of the mounting plate. The downwardly bent free end of the leaf spring then cooperates with the above-mentioned abutment in the hollow of the mounting plate.

BRIEF DESCRIPTION OF THE DRAWING

The invention will be further explained in the following description of an embodiment in conjunction with the drawing, wherein:

FIG. 1 is a longitudinal cross section through the center of the cabinet-wall-related part of a hinge according to the invention, which is held on its mounting plate, FIG. 2 is a plan view of the mounting plate, as seen in the direction of arrow 2 in FIG. 1, FIG. 3 is a longitudinal cross section through the leaf spring provided in the hollow of the mounting plate, showing its catch, and FIG. 4 is a plan view of the leaf spring, as seen in the direction of the arrow 4 in FIG. 3.

DETAILED DESCRIPTION OF THE PREFERRED EMBODIMENT

In FIG. 1, only the parts of a hinge, generally indicated at 10, which are to be fastened to a cabinet are shown, namely the cantilever arm 12 and its mounting plate 14, which is to be screwed to the wall of the cabinet, and on which the arm 12 is mounted so as to be adjustable and, in its configuration according to the invention, secured against accidental separation when the fasteners holding it thereon are loosened. Let it be assumed that the door-related part in the form of a cup mortised in the back of the door is coupled by a linkage mechanism, not shown, to the left end of the arm 12 as shown in FIG. 1. The linkage mechanism may be, for example, a common four-joint mechanism formed by two hinge links whose ends are journaled in a conventional manner in the cup at one end and on the arm 12 on the other. The bores 16*a* and 16*b* shown at the left end of the arm in FIG. 1 serve to accommodate pivots for the hinge links mentioned above.

As stated, the arm 12 can be fastened adjustably on the mounting plate 14 which, in the present case, is an adjustable-height, so-called "wing plate." The height adjustment is provided by means of a known two-part construction of the mounting plate 14 having a bottom part 14*a* that can be screwed directly to the cabinet wall, and an upper part 14*b* which is adjustable on this bottom part 14*a* in the direction of the height of a door that is to be hung by means of the hinge according to the invention, i.e., in FIG. 2, showing the mounting plate alone in plan, in a vertical direction. The height adjustment and the manner in which it is achieved is not, however, part of the present invention and therefore is not further described, inasmuch as the securing of the arm 12 against unintentional separation from the mounting plate, which is striven for in the invention, can be achieved in the same manner even in one-piece mounting plates which are not adjustable in height. The mounting plate 14 has a bridge 18 from which flat, wing-like projections 20 extend, each having a through-bore 22 for fastening. It is these wing-like projections 20 that give such mounting plates their name of "wing plates." For the invention, however, it is immaterial whether the mounting plate is configured as a wing plate in this manner, or is in the otherwise common oblong configuration.

The arm 12, which is made by stamping from sheet metal, is substantially channel-shaped, with flanges 24 joined along their upper margins by a web 26. In the end portion situated on the left in FIG. 1, the previously mentioned bores 16*a* and 16*b* are provided in the flanges 24 for the pivot pins of the hinge links.

In the substantially flat, sunken end portion 32 of the web 26, which is on the right in FIG. 1, i.e., the side opposite the hinge linkage, there is provided a longitudinal slot 34, open at the end of the arm, which serves to accommodate the threaded shaft of a screw 36 by which the arm 12 is fastened at its end remote from the hinge linkage to the mounting plate 14. The underside of the sunken end portion 32 is best provided with transverse serrations.

At a distance from the sunken end portion 32, a tap 38 is provided centrally in the web 26, into which a threaded spindle 40 is driven, to whose inner end between the flanges 24, a holding head 40*b* of enlarged diameter is connected by a constricted neck section 40*a*. Between the threaded portion of the spindle 40 and the holding head a circumferential groove is thus formed. The sunken portion 32 forms at its front end facing the hinge linkages, between the flanges 24, an abutment 44, which will be further explained below.

The bridge 18 of the mounting plate 14, which is higher than the wing-like projections 20, has a width in its upper portion corresponding approximately to the free width between the inside faces of the flanges 24 of the arm 12, so that the arm 12 can therefore be slid onto the mounting plate such that the flanges 24 straddle the bridge 18. In the right end portion of mounting plate 14 as seen in FIG. 1, there is provided a surface for fastening 46, with transverse serrations corresponding to the above-mentioned transverse serrations in the end portion of the arm 12. A bore 46a is provided in about the middle of the fastening surface 46 through which the shaft of the screw 36 is fitted with clearance. At its front end, the bridge 18 is provided with a longitudinal groove 48 which is open at its left end and is narrower at its upper side where it is wide enough to permit the neck section 40*a* between the holding head 40*b* and the threaded portion of the spindle 40 to be fitted into it. The mounting of the arm 12 on the mounting plate 14 is performed by sliding the arm with its longitudinal slot 34 under the head of the screw 36 which is held in the space under the bridge 18 in a thread provided underneath the bore 46*a*, and has been loosened, and at the same time the neck section 40*a* is slipped into the narrowed longitudinal groove 48. It can be seen that the arm 12 can be fastened at selectable positions on the mounting plate 14 along the slot 34, and that the holding of the arm against longitudinal displacement is then accomplished by tightening the screw 36 to draw the transverse serrations on the underside of the end portion 32 against the transverse serrations of the fastening surface 46. It can also be seen that the distance between the front (left) end of the arm 12 and the mounting plate bottom formed by the underside of the wing projections 20 can be varied on an associated cabinet wall by changing the depth of the threaded spindle 40 in the tap 38. The arm 12 is therefore adjustable in two coordinate directions, namely in the lengthwise direction and at right angles thereto, i.e., approximately perpendicularly to the cabinet wall surface, in addition to the adjustability in height that is provided in the mounting plate.

As it can be seen especially in FIG. 1, a catch in the form of the leaf spring 50 shown separately in FIGS. 3 and 4 is disposed in the hollow space under the bridge 18. This substantially planar leaf spring 50 has a hole 52 punched in its right end, by means of which it is riveted at 54 against the underside of the bridge 18. In alignment with the bore 46*a* in the fastening surface 46 on the bridge 18, the leaf spring 50 has a threaded eye 56 whose thread matches the thread on the shaft of the screw 36. When screw 36 is tightened, therefore, its threaded portion is driven through the threaded eye 56 until its head is pressing sufficiently tightly on the margins of the recess 32 which define the sides of the longitudinal slot 34, and thus the serrations in the bottom of the recess 32 and those in the upper side of the fastening surface 46 are pressed against one another. At the same time the leaf spring 50 is pressed in firm engagement with the underside of the bridge 18. The end of the leaf spring 50 that is on the left in FIG. 1 extends beneath a cutout 58 in the bridge 18 and is provided with the double bend 60, which will be described in conjunction with FIGS. 3 and 4. Owing to the double bend 60, this end portion of the leaf spring enters into the cutout 58, and the edge 64 of a tongue 62 stamped out of the leaf spring 50 projects above the top of the bridge 18. It is evident that the catch 62 permits the arm 12 to slide over the edge 64 in the direction of withdrawal from the mounting plate with screw 36 loosened, but only until it comes in contact with the abutment 44 provided on the arm 12. It is assumed that this contact will occur just as the shaft of the screw 36 enters into the open end of the slot 34 and the holding head 40*b* enters into the mouth of the longitudinal groove 48, i.e., the catch formed by tongue 62 with the abutment 44 restricts the adjustability of the arm on the mounting plate to a range in which there is still no danger of accidental release. Adjustment in the opposite direction, however, i.e., in the direction of the cabinet interior, is not prevented, so that the arm is therefore mounted on the mounting plate so as to be adjustable to the usual extent, but is secured against accidental separation from the mounting plate.

There are two ways of removing the arm 12 completely from the mounting plate 14. Either the screw 36 is backed out by a certain, relatively small amount, so that its head can assume, for example, the position represented in broken lines in FIG. 1. Then, when the tip of the screwdriver, also indicated in broken lines is pressed against the head of the screw 36, the leaf spring 50 will flex and its free end bearing the catch 62 will withdraw below the surface of bridge 18 into the cutout 58, thus disengaging the catch 62 from the abutment 44, and the arm can then be withdrawn from the mounting plate. Alternatively, it is also possible to drive the screw further in to such an extent that such a gap is created between the head of the screw and the rearward end of the arm that this rearward end can be lifted over the edge 64 of catch 62. However, the first-described method is to be preferred, since it assures that the arm, when later slipped onto the mounting plate, will snap over the protruding end of the leaf spring and then be automatically re-secured.

So that the force to be exerted on the head of the screw in order to flex the leaf spring 50 will not be too high, the leaf spring 50 has in the area between its threaded eye 56 and the riveted end the opening 66 which can be seen in FIG. 4, which in the narrow leaf-spring areas alongside the opening reduces the resistance of the leaf spring 50 to flexing in comparison to the broader areas of the leaf spring. In this manner a relatively stiff material can be used in making the leaf spring, in which the danger of any accidental distortion of the free end does not exist.

To prevent an excessive flexing of the leaf spring, possibly resulting in permanent deformation, when the arm 12 is released from the mounting plate 14 in the manner described, an abutment 68 is provided within the hollow of the bridge 18 of the mounting plate, beneath the cutout 58, and as soon as the edge 64 of the tongue 62 is lowered below the level of the surface of the bridge the free end of the spring will abut against it.

I claim:

1. A cabinet hinge having a supporting-wall-related part in the form of an elongated supporting arm of substantially channel-shaped cross section and having means for pivotal connection to a door-related part; a mounting plate having a bottom surface for placement on and fastening to a supporting wall of a cabinet, a top surface essentially parallel to the supporting wall when mounted thereto, and also having at least one side surface essentially perpendicular to said top surface; said supporting arm being held releasably and adjustably in at least two coordinate directions on said mounting plate, said supporting arm having supporting-arm side walls at least partially straddling said mounting plate and also having a web joining said supporting-arm side walls, said web having a slot which is provided with an access opening at a transition area remote from said pivotal connection means; a mounting screw having a head, and a shank which is driven into said mounting plate and is adapted to pass from said access opening and through said slot; said supporting arm also being provided at a distance from said slot in said web with a tap through which may pass a headless screw for bearing against said mounting plate; a first abutment opposite said top surface of said mounting plate and facing an interior surface of said supporting arm and toward the pivotal connection means of said supporting arm; a resilient catch element disposed in the area of said mounting plate opposite said first abutment, said catch element having a second abutment pointing in a direction away from said pivotal connection means, said abutments being in such positions that upon a longitudinal displacement of said supporting arm on said mounting plate parallel to said top surface, said abutments will come into locking engagement with one another when said shank of said mounting screw driven into said mounting plate arrives in said transition area from said slot to said access opening, said resilient catch element being an elongated leaf spring arranged in the interior of said mounting plate and having a first end away from said pivotal connection means, said first end being connected to said mounting plate, said leaf spring extending from said first end towards said pivotal connection means, said leaf spring having a second end opposite said first end, said second end having a bend extending through a recess in said mounting plate towards said supporting arm, said bend forming said second abutment. said leaf spring having a threaded bore below said access opening, said access opening being wider than said shank, said shank passing freely through said access opening and being threaded into said threaded bore.

2. A cabinet hinge according to claim 1, wherein said first abutment of said supporting arm is formed by a sunken end portion of said web of said supporting arm.

3. A cabinet hinge according to claim 1, wherein said mounting plate has a hollow interior, below said recess of said mounting plate there being a third abutment for said bend, said third abutment being spaced below said recess in said mounting plate such that when said second abutment contacts said third abutment upon movement of said second end of said lead spring, the second abutment disappears below said top surface of said mounting plate.

4. A cabinet hinge according to claim 1, wherein said first end of said leaf spring is riveted to said mounting plate.

5. A cabinet hinge according to claim 1, wherein said leaf spring has a cutout adjacent said threaded bore to thereby decrease the resistance of the leaf spring to bending.

6. A cabinet hinge according to claim 1, wherein said leaf spring has a cutout in said second end, a tongue being formed by said cutout said second end of said leaf spring having an edge pointing towards said mounting plate while said tongue has a free end forming said second abutment extending through said recess in said mounting plate.

* * * * *